US006575854B1

(12) United States Patent
Yang et al.

(10) Patent No.: US 6,575,854 B1
(45) Date of Patent: Jun. 10, 2003

(54) AUTOMATIC ADJUSTING DEVICE FOR ADJUSTING THE POSITION OF THE CENTER OF GRAVITY OF AN OBJECT

(76) Inventors: Jian Kuo Yang, No. 36, Lane 177, Chang An West Road, Taipei City (TW); Chia-Ching Lin, F1. 4, No. 191, Sec. 4, Chung Ching North Road, Taipei City (TW); Der-Chuan Lin, F1. 4, No. 193, Sec. 4, Chung Ching North Road, Taipei City (TW); San Hsiang Yeh, No. 7, Kuang Hsing Street, Shu Lin City, Taipei County (TW)

( * ) Notice: Subject to any disclaimer, the term of this patent is extended or adjusted under 35 U.S.C. 154(b) by 0 days.

(21) Appl. No.: 10/011,408

(22) Filed: Dec. 11, 2001

(51) Int. Cl.[7] ..... A63B 49/02; A63B 53/00; A63B 59/00

(52) U.S. Cl. ..... 473/519; 473/564; 473/318; 473/333

(58) Field of Search ..... 473/519, 524, 473/564, 559, 527, 463, 461, 457, 318, 333, 297, 345, 349

(56) References Cited

U.S. PATENT DOCUMENTS

| | | | | | |
|---|---|---|---|---|---|
| 514,420 | A | * | 2/1894 | Jacobus | 473/519 |
| 3,116,926 | A | * | 1/1964 | Owen et al. | 473/256 |
| 3,907,292 | A | * | 9/1975 | Moreland | 473/519 |
| 3,963,239 | A | * | 6/1976 | Fujii | 473/519 |
| 4,274,631 | A | * | 6/1981 | Hayazaki | 473/457 |
| 4,317,567 | A | * | 3/1982 | Blake | 473/233 |
| 4,614,343 | A | * | 9/1986 | Radway | 473/234 |
| 4,671,508 | A | * | 6/1987 | Tetreault | 473/201 |
| 4,969,921 | A | * | 11/1990 | Silvera | 473/234 |
| 5,121,922 | A | * | 6/1992 | Harsh, Sr. | 473/251 |
| 5,779,571 | A | * | 7/1998 | Roggenkamp | 473/519 |
| 5,803,829 | A | * | 9/1998 | Hayashi | 473/326 |

FOREIGN PATENT DOCUMENTS

| | | | | |
|---|---|---|---|---|
| FR | 2525113 | * | 10/1983 | 473/FOR 171 |
| GB | 2314027 | * | 12/1997 | A63B/15/00 |
| JP | P2000-202082 A | * | 7/2000 | A63B/69/00 |

* cited by examiner

*Primary Examiner*—Raleigh W. Chiu
(74) *Attorney, Agent, or Firm*—Rosenberg, Klein & Lee

(57) ABSTRACT

An automatic adjusting device for adjusting the position of the center of gravity of an object comprises a weighting element, an elastic element, a base seat, and a hollow tube body. One end of the weighting element is connected to the elastic element and another end of the elastic element is connected to the base seat, such that the weighting element, the elastic element and the base seat are positioned within the hollow tube body. Initially, the C.G. of the device is located at the handle region of the device, and when the tube body is rapidly swung, the weighting element produces a centrifugal force that is greater than the force of the elastic element to move the weighting element to the front end of the tube body and move the C.G. simultaneously. When the swinging force of the tube body is released, the pulling force of the elastic element will cause the weighting element to be restored to its original position, and the C.G. will be simultaneously restored to its original position as well.

3 Claims, 14 Drawing Sheets

AUTOMATIC ADJUSTING DEVICE FOR ADJUSTING THE POSITION OF THE CENTER OF GRAVITY OF AN OBJECT

BACKGROUND OF THE INVENTION (a) Technical Field of the Invention

The present invention relates to an adjusting device for the center of gravity (C.G.) of an object, and in particular, by employing centrifugal force of an object to adjust the C.G. of the object so that a maximum impact force is produced when a racket or the like containing the device hits a ball or the like.

(b) Description of the Prior Art

The center of gravity (C.G.) of a tennis racket, a squash racket, a badminton racket, a table-tennis bat, a baseball bat, a golf club, etc. is normally located at a fixed position. The positions of the C.G. of these racket/bats change in accordance with the shape and weight thereof. The position of the C.G. of some of these rackets is located at the front-end region of the body of the rackets, or may be located at the rear end region thereof. However, the center of the gravity of the body of these rackets cannot be effectively changed with respect to the swinging of the rackets. Thus, the force of impact by these rackets/bats is limited and in some instances, the swinging action cannot be effectively carried out. As a result, the weight of the handle end or the front end has to be increased to change the position of C.G. However such improvement cannot provide both the advantages of easily holding of the rackets/bats and effective impact rendered by the rackets/bats.

Accordingly, it is an object or the present invention to provide an automatic adjusting device for position of center of gravity of an object, wherein the position of C.G. changes in accordance with the swinging action of the racket containing the device of the present invention, and at the same time, the racket can be steadily hold by the user and the impact force is at a maximum.

SUMMARY OF THE INVENTION

Accordingly, it is an object to provide an automatic adjusting device for position of center of gravity of an object, which mitigate the above-mentioned device.

Yet another object of the present invention is to provide an automatic adjusting device for position of center of gravity of an object, wherein the device comprises a weighing element, an elastic element, a base seat, a hollow tube body, characterized in that one end of the weighing element is connected with the elastic element and the base seat, such that the weighing element, the elastic element and the base seat are positioned within the hollow tube body, the C.G. of the device is located at the handle region of the device, and in application, the tube body is rapidly swung and the weighing element produces a centrifugal force which is greater than that of the elastic element, and the weighing element is instantaneously moved to the front end of the tube body and the C.G. will move simultaneously, when the swinging force of the tube body is released, the pulling force of the elastic element will cause the weighing element to restore to its original position and the C.G. is simultaneously restored to its original position, thereby the C.G. position of the tube body is automatically changed and the force of impact is increased in multiple folds.

Still another object of the present invention is to provide an automatic adjusting device for position of center of gravity of an object, wherein the device can be employed on rackets or bats such that the center of gravity of the rackets or bats will change automatically when the bats or the rackets are swung.

A further object of the present invention is to provide an automatic adjusting device for position of center of gravity of an object, wherein the racket or the bat contained the device can provide an impact force which is greater than that produced with the conventional rackets or bats without the device.

Other object and advantages of the present invention will become more apparent from the following description taken in conjunction with the accompanying drawing.

DETAILED DESCRIPTION OF THE PREFERRED EMBODIMENT

Figure 1:
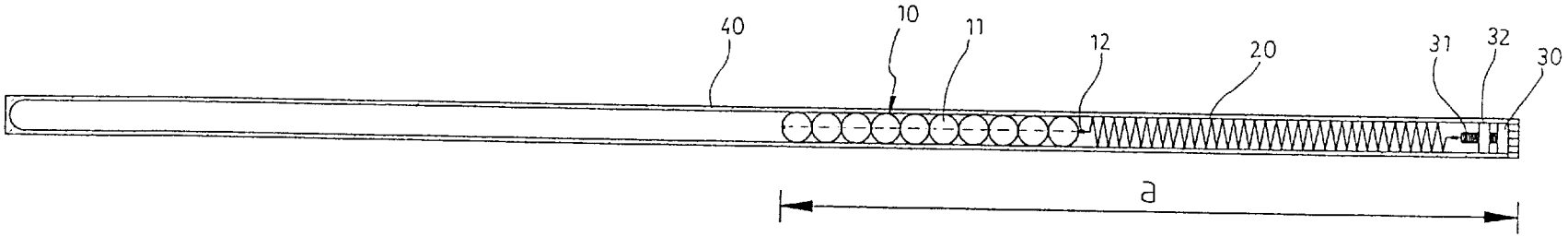
FIG. 1 is a sectional view of the automatic adjusting device for position of center of gravity for an object of the present invention.
Figure 2:
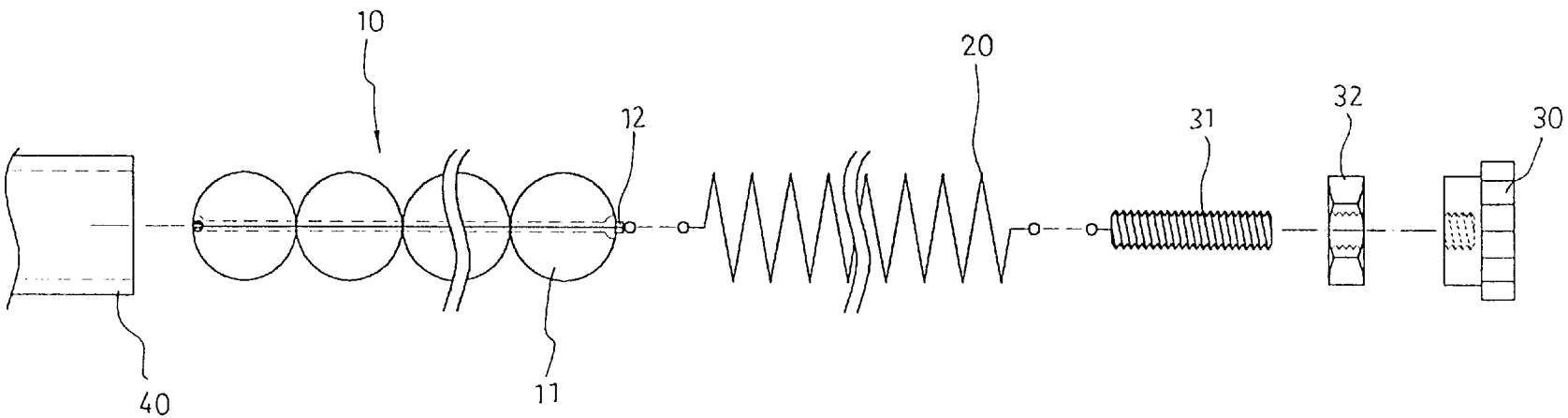
FIG. 2 is an exploded view of FIG. 1.
Figure 3:
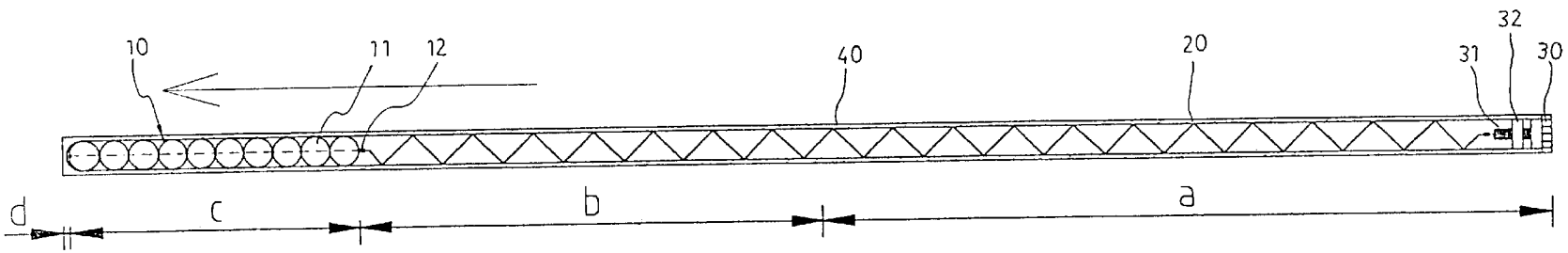
FIG. 3 shows the state of the internal of the tube body when the tube body is swung in accordance with the present invention.

Referring to FIGS. 1 and 2, there is shown an automatic adjusting device for position of center of gravity of an object comprising a weighing element 10, an elastic element 20, a base seat 30, a hollow tube body 40. The weighing element 10 is formed from a plurality of spheres 11 wound with flexible wire body 12 as a unit so that the weighing element 10 can form into appropriate shape for all sorts of curved tube bodies, and the weight of the weighing element can be adjusted to fit individual's physical capability. One end of the weighing element 10 is connected to an elastic element 20 and is interconnected to the base seat 30. The base seat 30 has a screw rod 31 connected to the spring element 20 at one end. A securing seat 32 is positioned on the screw rod 31.

The combination of the weighing element 10, the elastic element 20, the base seat 30 is positioned into the hollow tube body 40, wherein the base seat 30 and the securing seat 32 are located close to the tube opening of the body 40 so that the securing seat 32 is fixed and the base seat 30 can be rotated. Thus, when the spring element 20 becomes fatigue, rotate the base seat 30 so that the screw rod 31 rotates and the spring element 20 is driven backward to maintain the basic spring force of the spring element 20.

Figure 10:
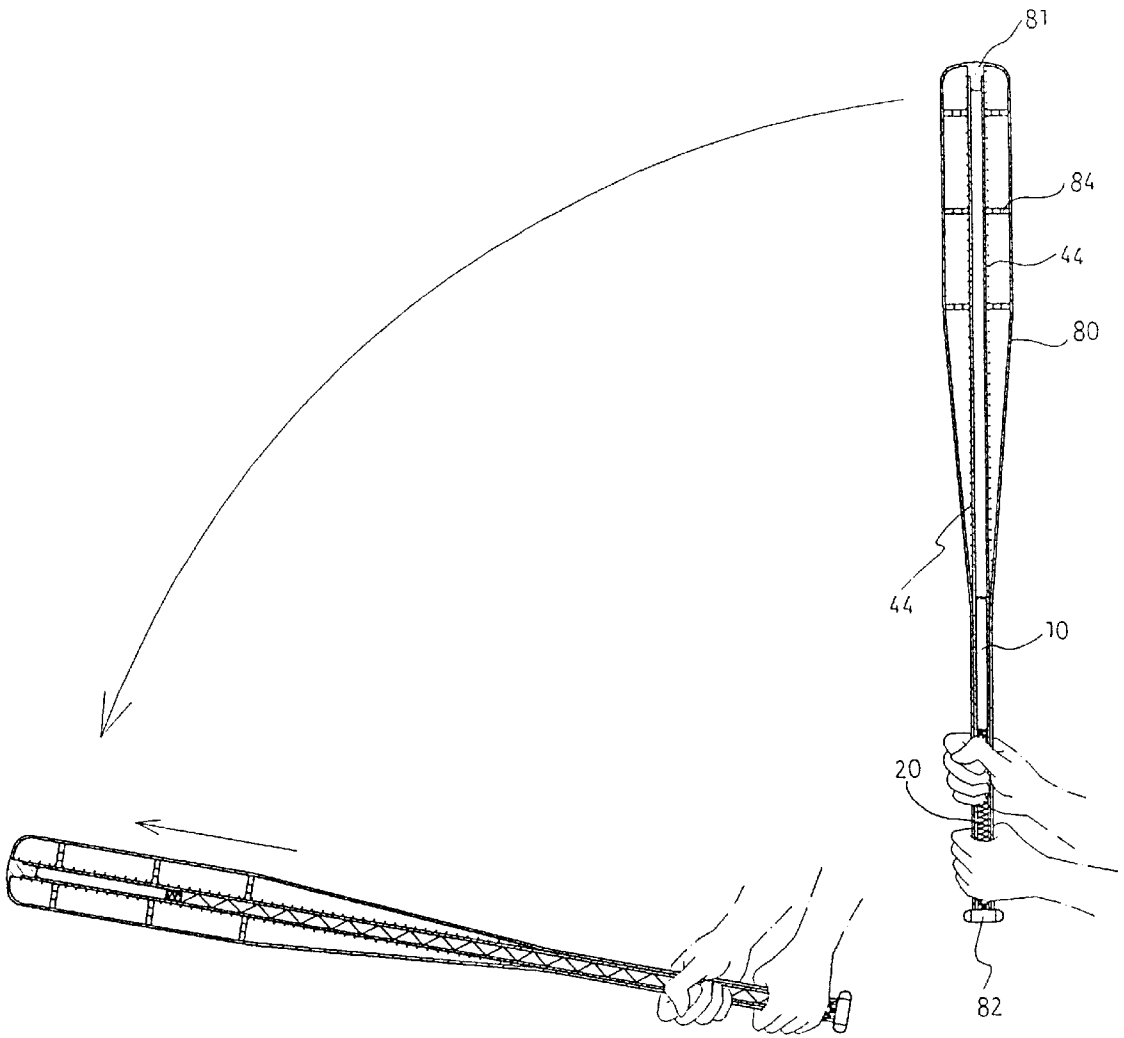
FIG. 10 is a schematic view showing the state of the interior of the baseball bat of FIG. 9.

Referring to FIGS. 1 and 2, at normal condition the weighing element 10, the elastic element 20, the base seat 30 are located at the end of the handle section a of the tube body 40, and the elastic element 20 retracts inward, and the weighing element 10 is concentrated on the handle section a. When the user holds the handle section a to prepare for a swinging action, i.e., the front end of the tube body 40 facing the top (as shown in FIG. 10), the weighing element 10 will move downward automatically as a result of position of the center of gravity. That is, at this instance, the weight center of the tube body 40 is located at the handle section a. This facilitates the holding of the user prior to a swinging action.

Figure 4:
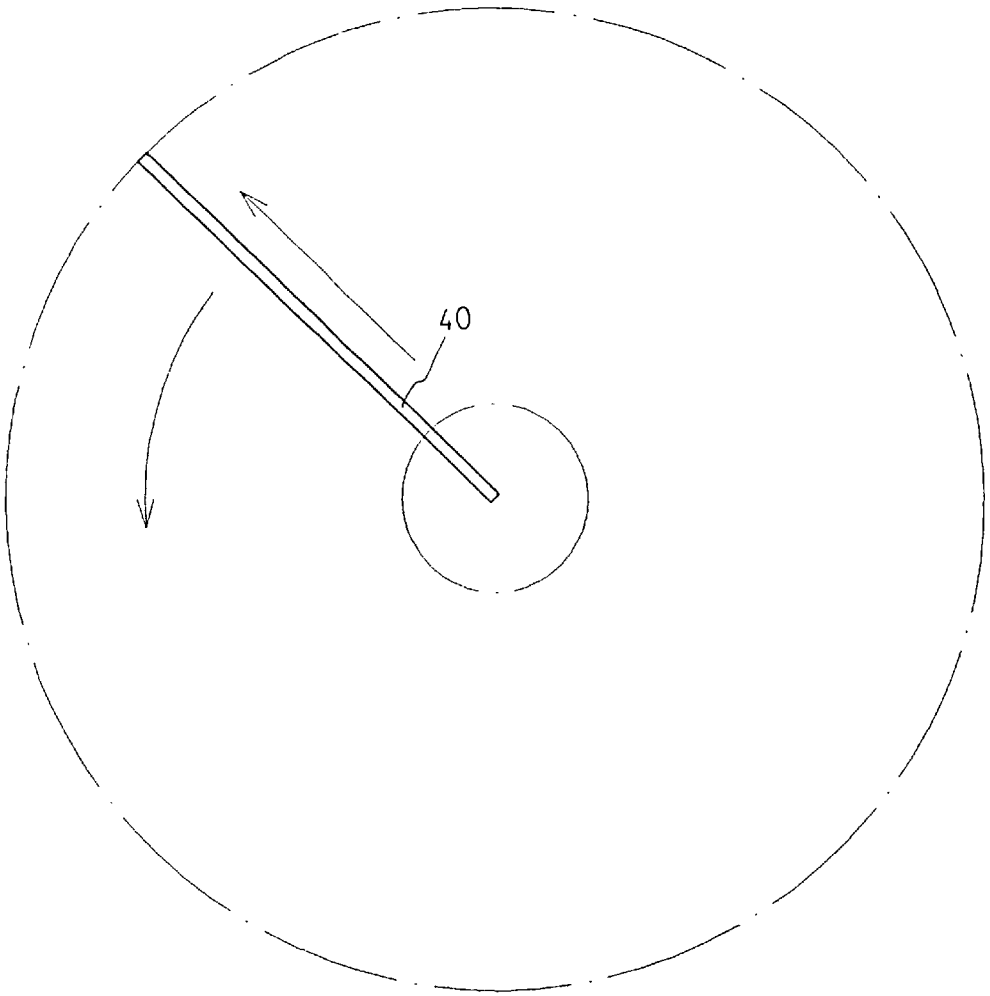
FIG. 4 is schematic view showing the displacement of the weighing element in accordance with the present invention.

Referring to FIG. 4, when the user's hands holding the handle section a move from the top to the bottom or from left to right to produce a swinging action, the weighing element 10 will instantaneously produce a centrifugal force greater than the pulling force of the elastic element 20 by multiple folds, and rapidly passes to the accelerating region b and is located at the impact region c and impacts at the stopping point d at the front end of the tube body 40.

The weight center of the tube body 40 moves to the front end and thus the position of weight center of the tube body 40 is automatically changed. Therefore, the impact force that produces by swinging will be several times greater, and when the device is employed on rackets, bats or clubs, the impact force is significant.

When the swinging force of the tube body 40 disappear, the weighing element 10 is pulled to its original position, and the user can continuously use the device.

Figure 5:
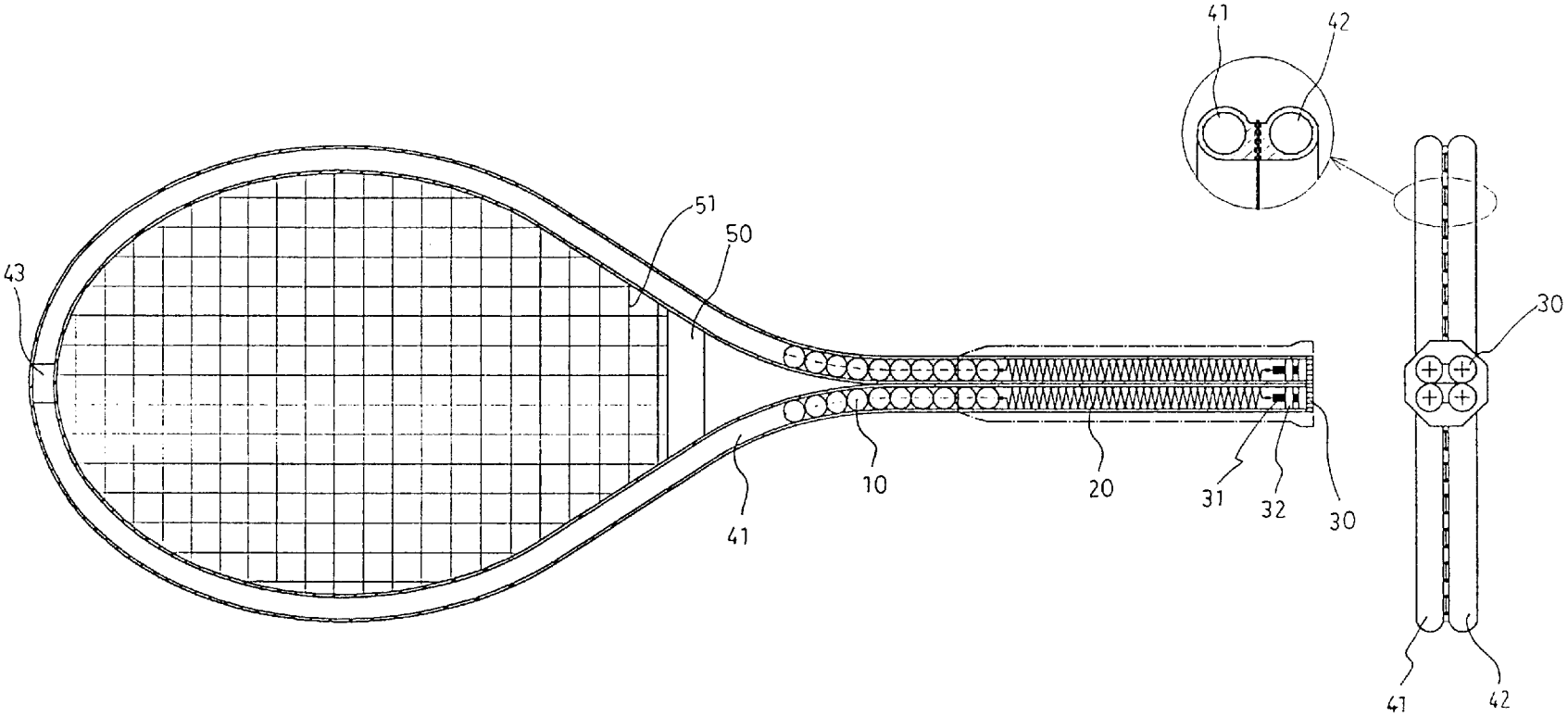
FIG. 5 is a schematic view showing the application of the present invention onto a tennis racket.
Figure 6:
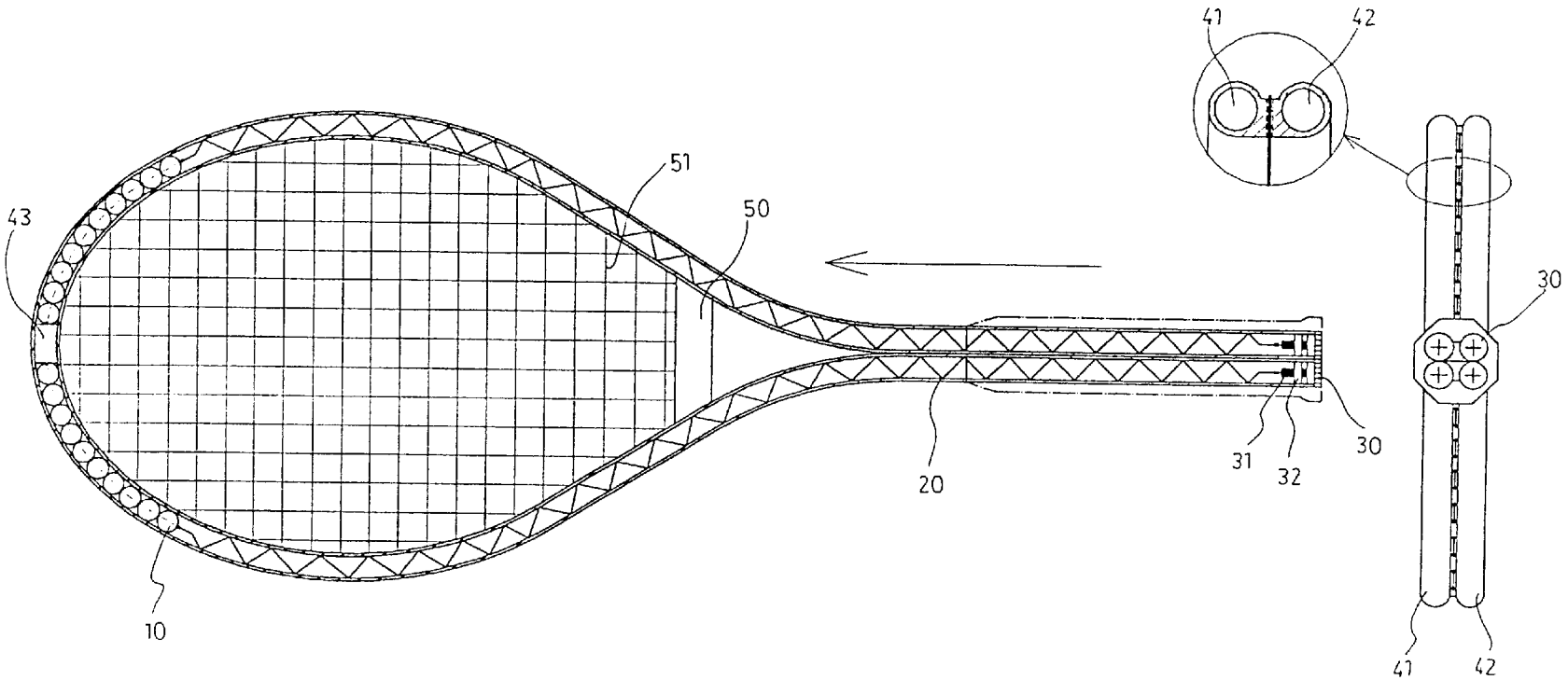
FIG. 6 is a schematic view showing the interior of the tube body of FIG. 5 when the tube is swung.

Referring to FIG. 5, the present tube body 40 can be made into external frame of a tennis racket 50. There are two passages 41, 42 at the left and right side of the racket shaft for the insertion of the weighing element 10, the elastic element 20, the base seat 30, and the front end connection regions of the passages 41, 42 are located at the stopping end 43. The passages 41, 42 can be an integral part of the racket frame 50. The space between the two passages 41,42 can be used to provide string 51 arrangement. Therefore, at normal condition, the weighing element 10 of the racket 50 is located at the handle region of the racket, which facilitates holding of the racket. As shown in FIG. 6, when the user swings a racket, the weighing element 10 will move to the stopping end 43 along the shape of the tube body 40 and the weight center is thus automatically adjusted. After that, the weighing element 10, the elastic element 20 will automatically restore to their original position.

Figure 7:
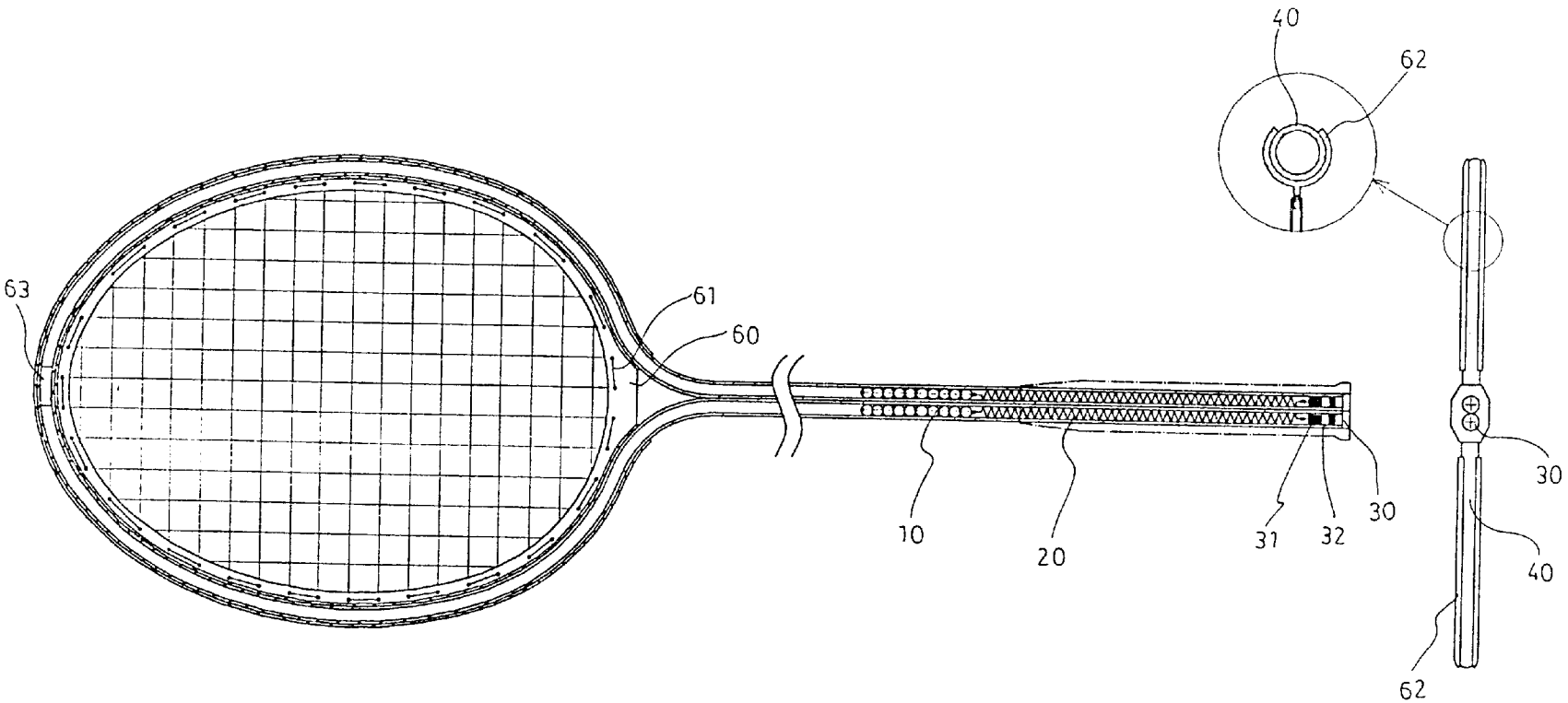
FIG. 7 is a schematic view showing the application of the present invention onto a badminton racket.

Referring to FIG. 7, the tube body 40 can be formed into external frame of a badminton racket. To facilitate the formation of the string net 61, a net frame 60 is first formed, and the frame 60 is provided with recesses 62 for securing of the tube body 40. The connection region of the front end of the tube body 40 is provided with a stopping end 63. The action of the tube body 40 is similar to that of the racket described in earlier paragraph.

Figure 8:
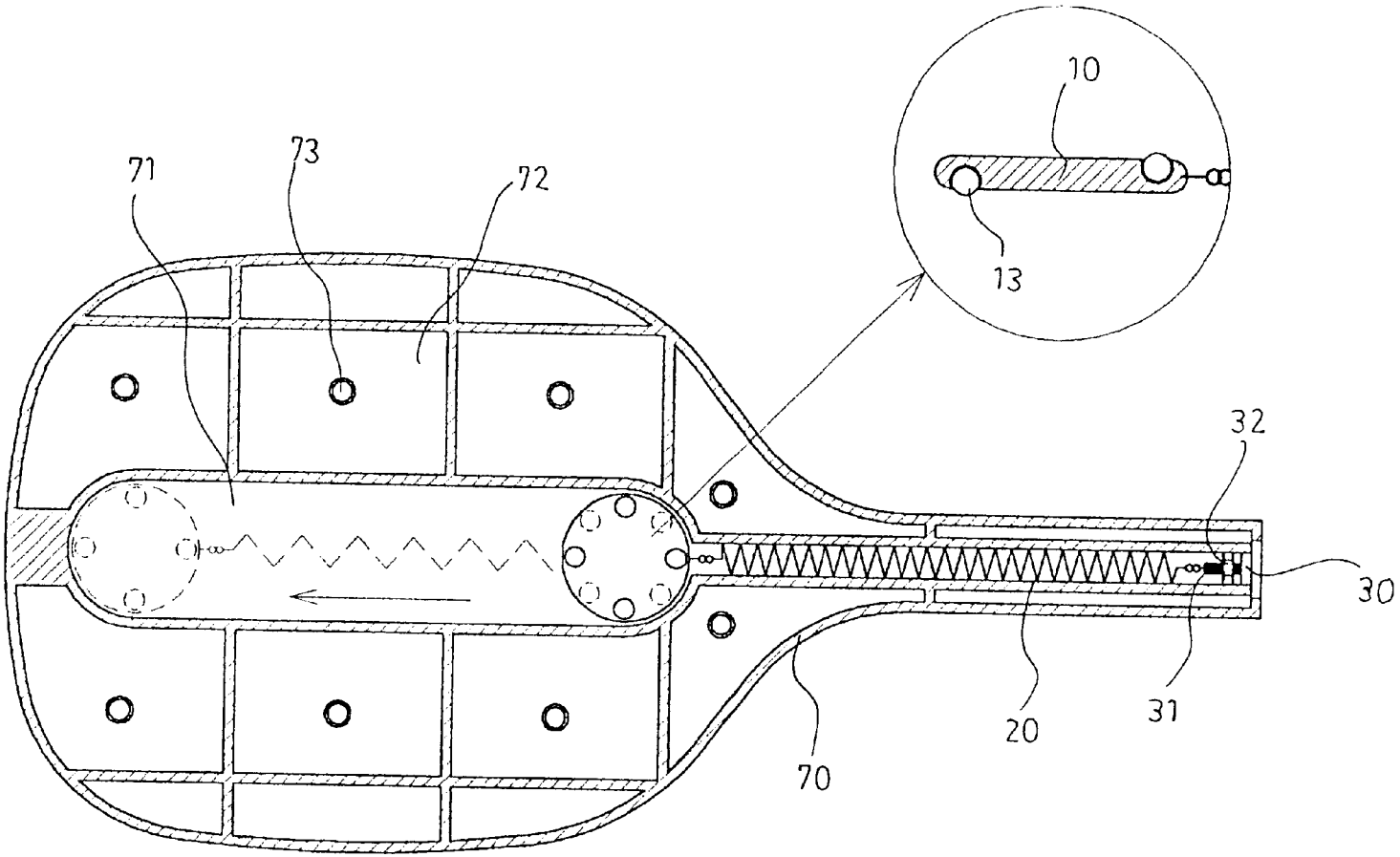
FIG. 8 is a schematic view showing the application of the present invention onto a table-tennis bat.

Referring to FIG. 8, the weighing element 10, the elastic element 20, the base seat 30, the securing seat 32 can be directly positioned into the passages 71 of the table-tennis bat 70. The weighing element 10 is a smooth disc having the top and bottom surface thereof being provided with rollers 13, allowing smooth sliding of the weighing element 10. The action of the tube body is similar to that of the tennis racket. In order to reduce the weight of the table tennis racket 70, a plurality of spacing 72 are provided within the table-tennis bat 70, and a mounting structure 73 is provided allowing easily mounting of the top and bottom face of the table-tennis bat 70.

Figure 9:
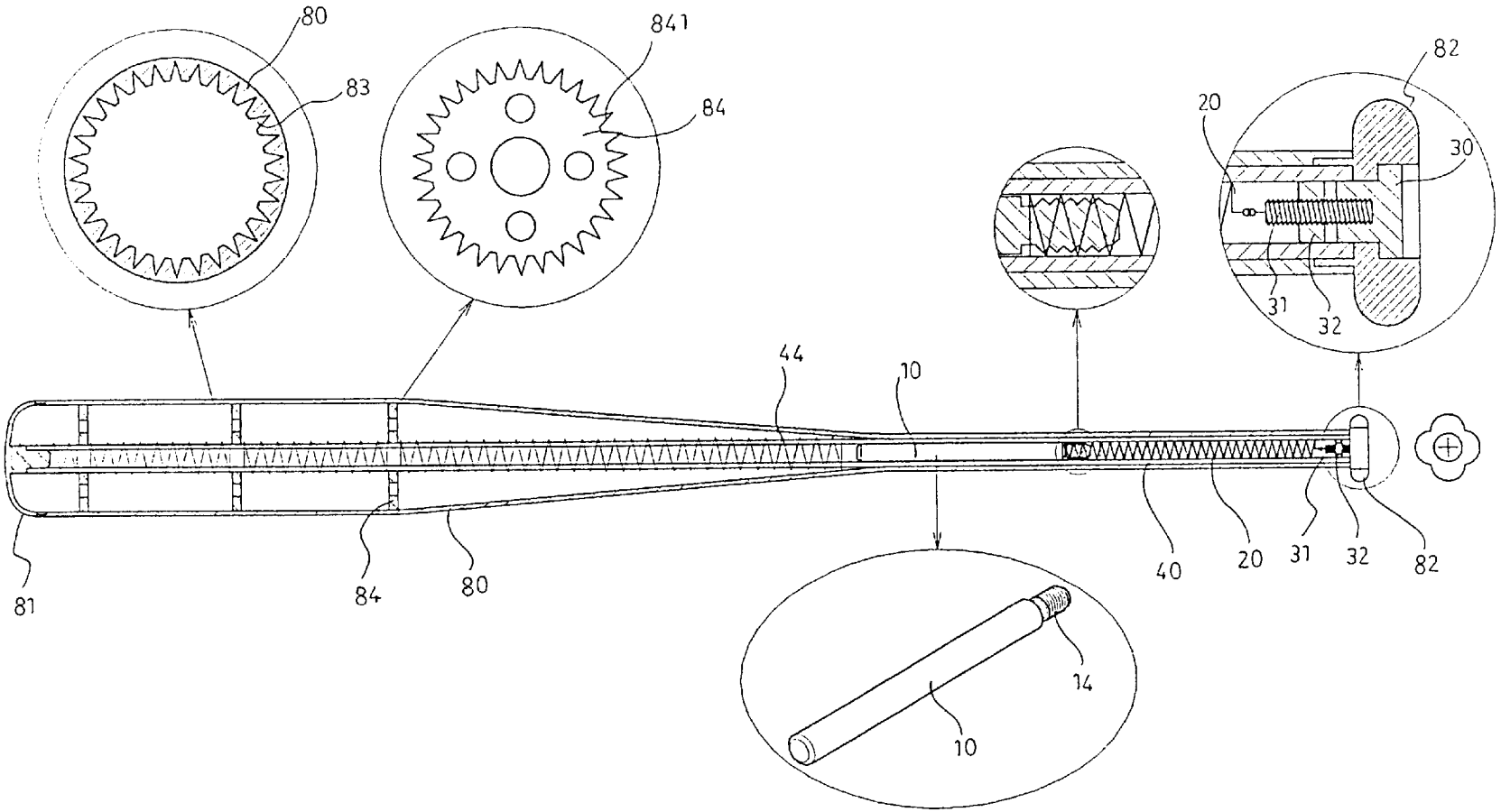
FIG. 9 is a schematic view showing the application of the present invention on a baseball bat.

Referring to FIG. 9, the weighing element 10, the elastic element 20, the base seat 30, the tube body 40 can be mounted to the baseball bat 80, and the top cover 81 and the bottom cover 82 at the front and rear end of the bat 80 are used to mount the components. The shape of the weighing element 10 is elongated as that of the bat 80, and the end of the weighing element 10 has a screw portion 14 so as to directly connect with the spring element 20. The action of the device (refer to FIG. 10) is similar to that of the tennis racket. In order to reduce the weight of the bat 80 and to increase the strength of the bat structure, the bat 80 is hollow and the inner wall of the bat 80 is provided with a plurality of slots 83 so that the entire surface is provided with an enhancing element 84 with rib 841, which can be directly mounted to the interior of the bat 80.

Thus, the bat 80 will not be damaged or dented when the bat 80 hits a ball. The exterior of the tube body 40 is provided with a plurality of elastic elements 44 and the end portions thereof urge the enhancing elements 84. Thus, the strong shock to the bat 80 on impacting with a ball will be diminished by the elastic elements 44 and further, the loosening of the enhancing element 84 can be prevented.

Figure 11:
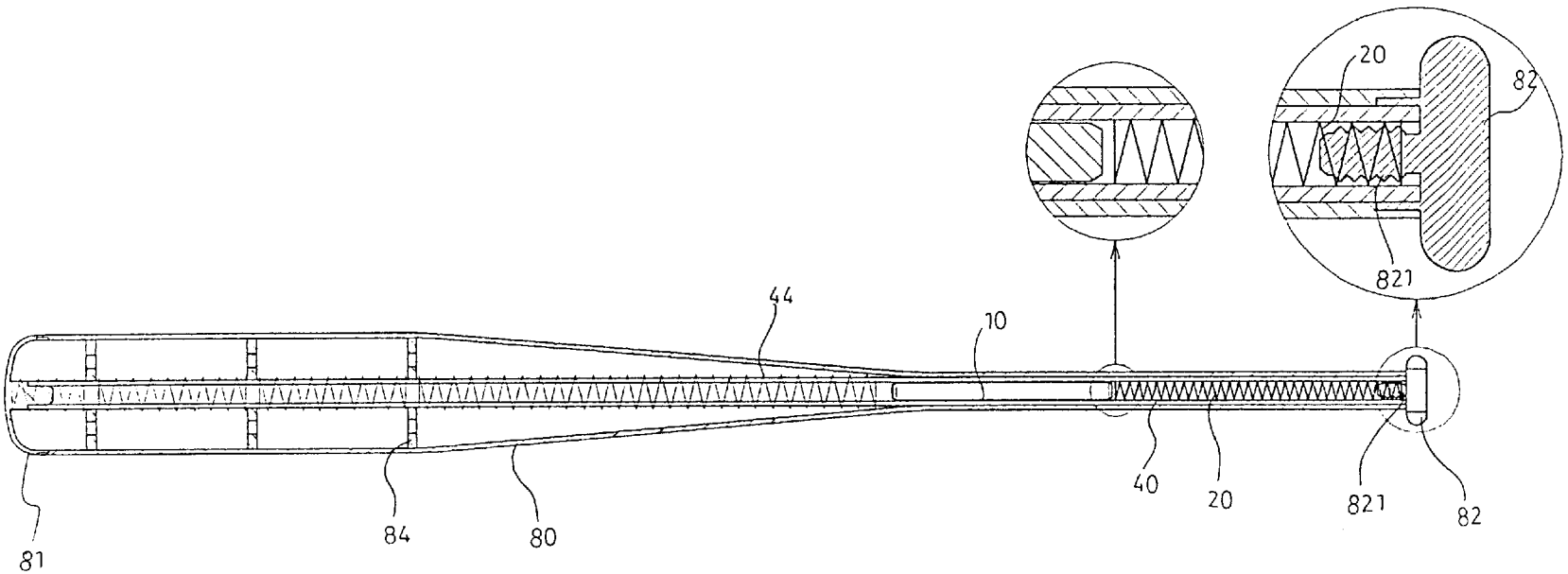
FIG. 11 is another structure of a baseball bat.
Figure 12:
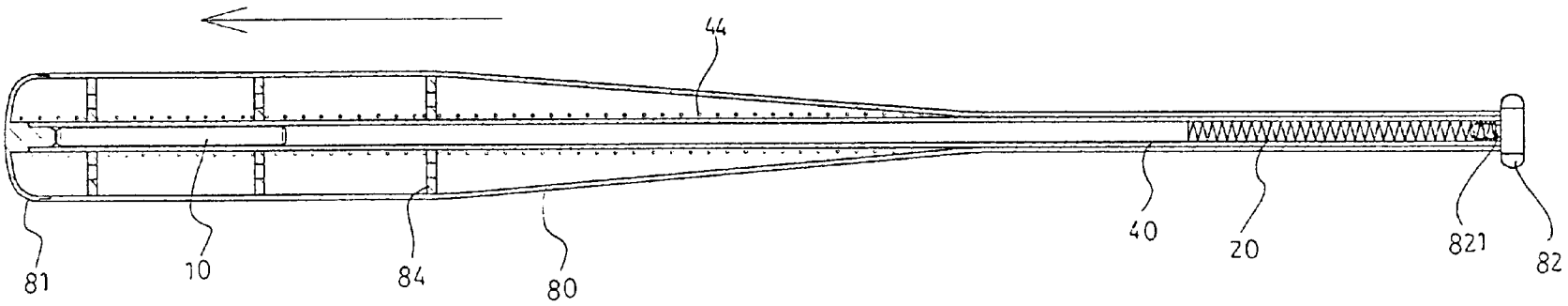
FIG. 12 is a schematic view showing the state of the interior of the baseball bat of FIG. 11, wherein the weighing element moves to the front end of the bat body.

FIG. 11 shows another preferred embodiment of bat structure shown in FIG. 9. The weighing element 10 has not connected to the elastic element 20, and one end of the elastic element 20 is mounted to the screw portion 821 provided to the bottom cover 82. The action of the device (FIG. 12) is the same as that of the tennis racket. When the bat 80 is hold in preparing a swing, the front end of the bat 80 faces the top, and the weighing element 10 moves downward. Thus, the weighing element 10 may not be connected to the elastic element 20, and similarly, the restoration to its original position can be obtained. Besides, the action of the elastic element 20 is used to prevent the weighing element 10 from directly impact with the rear cover 82, and also to provide a buffering action.

Figure 13:
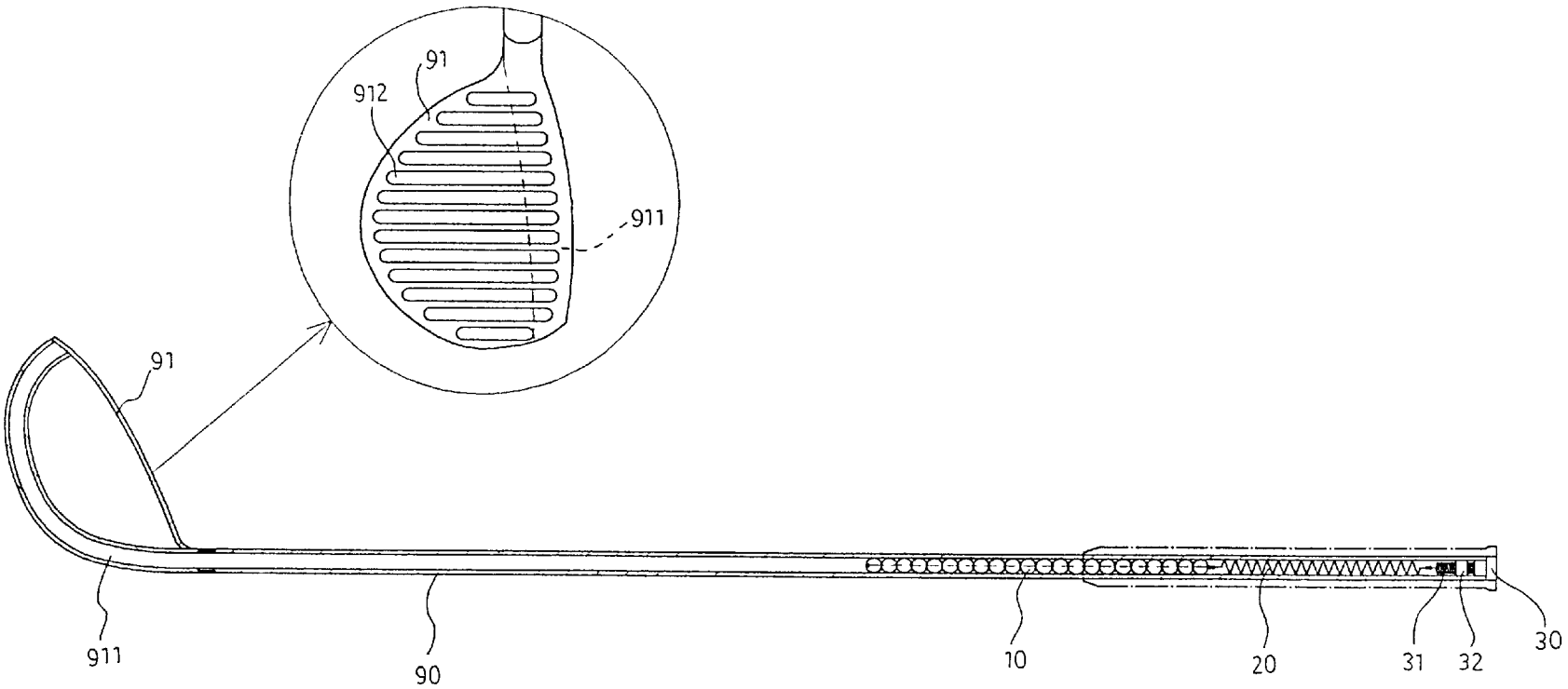
FIG. 13 is a schematic view showing the application of the present invention in the golf club.
Figure 14:
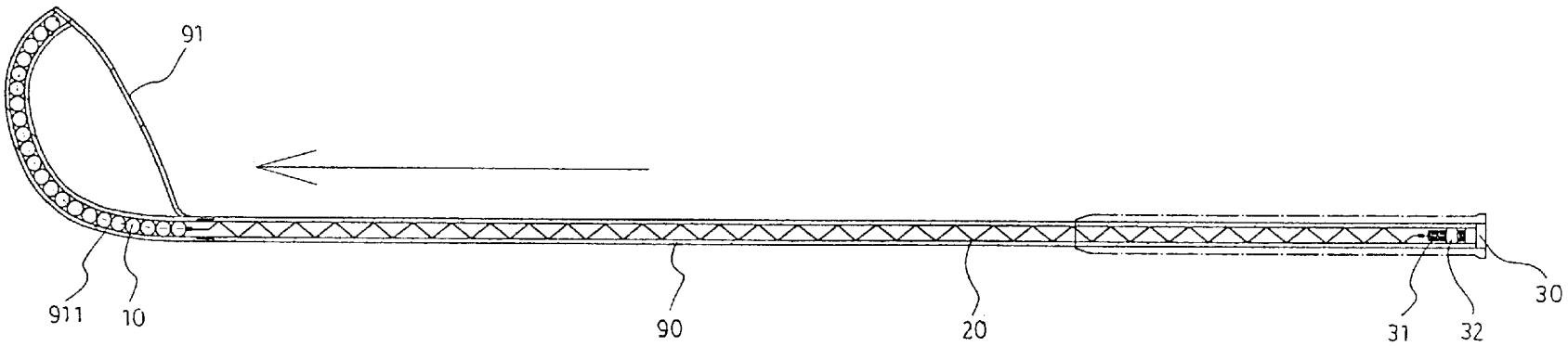
FIG. 14 shows the state of the interior of the club of FIG. 13, wherein the weighing element moves forward to the front end.

Referring to FIGS. 13 and 14, the weighing element 10, the elastic element 20, and the base seat 30 can be mounted to a golf club 90. The golf club 90 is a tubular shape body, which can hold these components. The interior of the club head 91 of the club 90 is provided with passage 911 in communication with the club 90. The action of the device (FIG. 14) is similar to that of the tennis racket. In order to reduce the weight of the club head 91, the top and bottom surface of the club head 91 are provided with a plurality of spacing.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

We claim:

1. An automatic adjusting device employing centrifugal force for adjusting a position of a center of gravity of a racket, the device comprising a weighting element, an elastic element, and a base seat respectively positioned in a hollow tube body, the hollow tube body being defined by a passage formed in the racket, one end of the weighting element being connected to an end of the elastic element and another end of the elastic element being coupled to the base seat, the weighting element being formed by a circular disc having a plurality of rollers on top and bottom surfaces thereof, the racket having a plurality of open spaces and mounting structures are provided within the racket, initially the center of gravity of the device is located in a handle region of the racket, and when the racket is swung the weighting element produces a centrifugal force that is greater then a pulling force of the elastic element, the weighting element is thereby displaced to a front end of the tube body and simultaneously moves the center of gravity of the device to increase an impact force of the racket, when the swing of the racket has ceased, the pulling force of the elastic element restores the weighting element to its original position and thereby restores the center of gravity of the device to its original position.

2. An automatic adjusting device employing centrifugal force for adjusting a position of a center of gravity of a bat, the device comprising a weighting element, a first elastic element, and a base seat respectively positioned in a hollow tube body, the hollow tube body being longitudinally disposed in the bat, a front and a rear end of the bat being respectively provided with a top cover and a rear cover for respectively mounting a front and a rear end of the tube body thereto, the bat having a hollow structure with a plurality of longitudinally extending grooves formed in an interior surface of a wall of the bat and a plurality of enhancing elements disposed in longitudinally spaced relationship within the bat, each of the enhancing elements having a plurality of ribs provided on a surface thereof and respectively engaged in said plurality of grooves in the interior surface of the wall of the bat, a plurality of second elastic elements being disposed external to the tube body and respectively disposed on opposing sides of each of the plurality of enhancing elements to apply a bias force thereto, one end of the weighting element being connected to an end of the first elastic element and another end of the first elastic element being coupled to the base seat, initially the center of gravity of the device is located in a handle region of the bat, and when the bat is swung the weighting element produces a centrifugal force that is greater then a pulling force of the first elastic element, the weighting element is thereby displaced to a front end of the tube body and simultaneously moves the center of gravity of the device to increase an impact force of the bat, when the swing of the bat has ceased, the pulling force of the first elastic element restores the weighting element to its original position and thereby restores the center of gravity of the device to its original position.

3. An automatic adjusting device employing centrifugal force for adjusting a position of a center of gravity of a golf club, the device comprising a weighting element, an elastic element, and a base seat respectively positioned in a hollow tube body, the hollow tube body being defined by a shaft of the golf club, one end of the weighting element being connected to an end of the first elastic element and another end of the first elastic element being coupled to the base seat, the golf club having a head with a passage formed therein in open communication with the shaft, the club head having top and bottom surfaces provided with a plurality of hollow spacing regions, initially the center of gravity of the device is located in a handle region of the shaft, and when the golf club is swung the weighting element produces a centrifugal force that is greater then a pulling force of the elastic element, the weighting element is thereby displaced to a front end of the tube body and simultaneously moves the center of gravity of the device to increase an impact force of the golf club, when the swing of the golf club has ceased, the pulling force of the elastic element restores the weighting element to its original position and thereby restores the center of gravity of the device to its original position.

* * * * *